United States Patent [19]

Kawachi et al.

[11] Patent Number: 4,670,328

[45] Date of Patent: Jun. 2, 1987

[54] NOVEL IMPREGNATED MATERIAL OF A COPOLYMER OF TETRAFLUOROETHYLENE AND PERFLUOROALKYL VINYL ETHER

[75] Inventors: Shoji Kawachi, Hyogo; Masayasu Tomoda, Shiga; Yutaka Ueta, Osaka; Masahiko Oka, Shiga, all of Japan

[73] Assignee: Daikin Industries, Ltd., Osaka, Japan

[21] Appl. No.: 834,554

[22] Filed: Feb. 28, 1986

[30] Foreign Application Priority Data

Feb. 28, 1985 [JP] Japan ..... 60-40635

[51] Int. Cl.[4] ..... B32B 27/00

[52] U.S. Cl. ..... 428/260; 428/272; 428/290; 428/421; 428/422

[58] Field of Search ..... 428/260, 272, 290, 421, 428/422

[56] References Cited

U.S. PATENT DOCUMENTS 4,600,651 7/1986 Aufdermarsh ..... 428/422

*Primary Examiner*—Marion C. McCamish

*Attorney, Agent, or Firm*—Birch, Stewart, Kolasch and Birch

[57] ABSTRACT

An impregnated material comprising an organic or inorganic material selected from the group consisting of a woven fabric, a non-woven fabric and an open cell porous material which is impregnated with a copolymer which comprises 50 to 95% by mole of repeating units derived from tetrafluoroethylene and 5 to 50% by mole of repeating units derived from perfluoroalkyl vinyl ether of the formula:

$$CF_2{=}CFOR_f \quad (I)$$

wherein $R_f$ is a $C_1$–$C_6$ perfluoroalkyl group or a group of the formula:

$$-(CF_2CFXO)_n-R_f \quad (II)$$

wherein $R_f$ is the same as defined above, X is a fluorine atom or a trifluoromethyl group and n is an integer of 1 to 10, which has good chemical, corrosion, solvent and oil resistance as well as water- and oil-repellence.

4 Claims, No Drawings

NOVEL IMPREGNATED MATERIAL OF A COPOLYMER OF TETRAFLUOROETHYLENE AND PERFLUOROALKYL VINYL ETHER

FIELD OF THE PRESENT INVENTION

The present invention relates to a novel impregnated material. More particularly, it relates to a fabric or a porous material impregnated with a specific fluorine-containing elastomeric copolymer.

BACKGROUND OF THE INVENTION

There are known impregnated materials prepared by impregnating woven fabrics or non-woven fabrics with a solution or dispersion of a vinylidene fluoride/hexafluoropropylene copolymer, a vinylidene fluoride/hexafluoropropylene/tetrafluoroethylene copolymer or a tetrafluoroethylene/propylene copolymer. However, materials impregnated with these fluorine-containing elastomeric copolymers are not necessarily excellent in chemical resistance, corrosion resistance and oil resistance, and do not necessarily have good water and oil-repellency.

SUMMARY OF THE INVENTION

One object of the present invention is to provide an impregnated material having not only good chemical, corrosion, solvent and oil resistance but also good water and oil-repellence.

Another object of the present invention is to provide an impregnated material with a fluorine-containing elastomeric copolymer having a gas permeability of which is freely adjusted.

According to the present invention, an impregnated material is provided comprising an organic or inorganic material selected from the group consisting of a woven fabric, a non-woven fabric and an open cell porous material which is impregnated with a copolymer which comprises 50 to 95% by mole of repeating units derived from tetrafluoroethylene and 5 to 50% by mole of repeating units derived from perfluoroalkyl vinyl ether of the formula:

$$CF_2{=}CFOR_f \quad \text{(I)}$$

wherein $R_f$ is a $C_1$–$C_6$ perfluoroalkyl group or a group of the formula:

$$-(CF_2CFXO)_n-R_f \quad \text{(II)}$$

wherein $R_f$ is the same as defined above, X is a fluorine atom or a trifluoromethyl group and n is an integer of 1 to 10.

DETAILED DESCRIPTION OF THE INVENTION

The fluorine-containing elastomeric copolymer to be impregnated in the material according to the present invention comprises tetrafluoroethylene and the perfluoroalkyl vinyl ether (I). The preparation of the copolymer is described in Japanese Patent Kokai Publication No. 71906/1985, U.S. Pat. No. 4,487,903 and European Patent Application No. 82 109 647.6.

The copolymer may further comprise at least one fluorine-containing ethylenically unsaturated comonomer such as vinylidene fluoride, vinyl fluoride, trifluorochloroethylene, trifluoroethylene, hexafluoropropylene, hexafluoroisobutylene, fluoroalkyl vinyl ether and the like. Among them, a fluoroalkyl vinyl ether of the formula:

$$CF_2{=}CFO-(CF_2CF_2)_n-CH_2Y \quad \text{(III)}$$

wherein n is the same as defined above, and Y is an iodine atom or a bromine atom is preferred.

The amount of the fluorine-containing ethylenically unsaturated comonomer to be contained in the copolymer is 0.1 to 20% by moles based on the total mole of tetrafluoroethylene and the perfluoroalkyl vinyl ether (I). The copolymerization of the comonomer improves vulcanizing characteristics, heat resistance and compression set of the copolymer.

In the copolymerization of the copolymer to be used according to the present invention, a chain transfer agent may be added in the polymerization system. Specific examples of the chain transfer agent are $C_4$–$C_6$ hydrocarbons, alcohols, ethers and halogenated hydrocarbons (e.g. $CCl_4$, $CBrCl_3$, $CF_2ClBr$, $CF_2BrCFBrCF_3$ and $CF_2I_2$). When a fluorocarbon iodide or a fluorocarbon bromide (e.g. $CF_2I_2$, $I(CF_2)_4I$, $CF_2{=}CFCF_2CF_2I$, $CF_2Br_2$, $BrCF_2CF_2Br$ and $BrCF_2CFBrCF_3$) is used as a chain transfer agent, an iodine or a bromine atom is bonded to the chain end of the copolymer and is still radically active so that the copolymer is vulcanized with a peroxide as a radical source in the presence of a polyfunctional unsaturated compound such as triallylisocyanurate and triallylcyanurate.

The organic or inorganic material to be impregnated according to the present invention includes woven and non-woven fabrics of natural fiber (e.g. cotton, wool and jute), semi-synthetic fiber, synthetic fiber and inorganic fiber (e.g. glass fiber, asbestos fiber, alumina fiber, carbon fiber and other ceramics fiber), paper, open cell porous materials (e.g. open cell plastic foam).

The fluorine-containing elastomeric copolymer is impregnated in the form of a solution or dispersion in a suitable solvent. The solid content of the copolymer in the solution or dispersion is at least 5% by weight. When the solution or dispersion has a low solid content, the impregnation step is repeated until a sufficient amount of the copolymer is carried by the material. When the solid content is large, the permeability of the solution or dispersion into the matrix of the material is decreased. Preferably, the solid content does not exceed 60% by weight.

The solvent is selected according to a processing temperature from perfluorocompounds such as perfluoroderivatives of benzene, tertiary amines, ethers, pyrane, alkanes and cycloalkanes having at least 6 carbon atoms. Among them, those having a boiling temperature of 60° to 180° C. such as perfluorobenzene, perfluorotriethylamine, perfluorotri-n-butylamine and the like are preferred.

For the preparation of the dispersion, a dispersing agent or an emulsifier is used. As a non-aqueous dispersing agent, there is exemplified a fluorinated compound such as $CCl_2FCClF_2$, $CClF_2CClF_2$, $CBrF_2CBrF_2$, and a combination of the fluorinated compound and a fluorine-containing surfactant. As an aqueous emulsifier, there is exemplified a compound of the formula:

$$R_f'COONH_4 \quad \text{(IV)}$$

wherein $R_f'$ is a $C_2$–$C_{10}$ fluoroalkyl group, and a compound of the formula:

$$R_f''—(OCFX'CF_2)_m—CFX'COONH_4 \quad (V)$$

wherein $R_f''$ is a $C_1$–$C_5$ fluoroalkyl group, X' is a fluorine atom or a trifluoromethyl group and m is an integer of 1 to 10.

When the copolymer contains a radically active iodine or bromine in the molecule as described above, a vulcanizing system such as a combination of a peroxide compound and a polyfunctional unsaturated compound having vinyl, allyl or acryl groups can be used. Since the fluorine-containing elastomeric copolymer and the vulcanizing system are commonly dissolved in only a few solvent, they are preferably used in the form of a dispersion. Preferred examples of the peroxide are 1,1-bis(t-butylperoxy)-3,5,5-trimethylcyclohexane, 2,5-dimethylhexane-2,5-dihydroxyperoxide, di-t-butylperoxide, t-butylcumylperoxide, dicumylperoxide, α,α'-bis(t-butylperoxy)-p-diisopropylbenzene, 2,5-dimethyl-2,5-di(t-butylperoxy)hexane, 2,5-dimethyl-2,5-di(t-butylperoxy)hexyne-3, benzoylperoxide, t-butylperoxybenzene, 2,5-dimethyl-2,5-di(benzoylperoxy)hexane, t-butylperoxymaleic acid, t-butylperoxyisopropylcarbonate and the like. Among them, the dialkyl type compounds are most preferred.

The solution or dispersion containing the fluorine-containing elastomeric copolymer optionally contains additives such as pigments and fillers.

The impregnation of the solution or dispersion in the material is carried out in various ways. For example, the solution or dispersion is sprayed or coated on the surface of the material, or the material is dipped in the solution or dispersion to penetrate the solution or dispersion into the matrix of the material. Then, the solvent or water is removed by drying.

The impregnated material of the invention can be used in an unvulcanized state, although it may be vulcanized by incorporating a vulcanizing system. When the material is vulcanized, it is heated under conditions suitable for employing the vulcanizing system. When the peroxide is used, the material is preferably heated and vulcanized in the absence of oxygen.

By adjusting the impregnated amount of the fluorine-containing elastomeric copolymer, the impregnated material can be gas permeable or non-porous.

The impregnated material of the invention can find various applications:

The permeable impregnated woven and non-woven fabric is used as a filter cloth or a filter by virtue of its porosity and corrosion and solvent resistance. The non-porous impregnated woven and non-woven fabric is used, for example, as a diaphragm valve.

The impregnated glass fiber fabric is used as a good liquid resistant element since the copolymer of the invention suffers less from corrosion with hydrogen fluoride than the conventionally used vinylidene fluoride/-hexafluoropropylene copolymer so that the glass fiber fabric is not corroded with hydrogen fluoride.

Since the gas permeable impregnated woven fabric has less fuzz, it is used as a material for dust free clothes desirable in the production of LSI or chemical resistant clothes. The impregnated material for these clothes is required to have good washing resistance. The impregnated material of the invention has excellent washing resistance and is suitable for clothes.

Further, the impregnated material may be used as a belt for a belt conveyor used in the food or medicine industries, where it is required to have good corrosion, solvent, oil, liquid and steam resistance.

For the production of an inexpensive impregnated material of the invention, the substrate material is first impregnated with a conventional fluorine-containing elastomer as an under layer and then with the fluorine-containing elastomeric copolymer as a top layer according to the present invention. To improve the affinity of the under layer with the top layer, the former may be a blend of the conventional fluorine-containing elastomer and the fluorine-containing elastomeric copolymer of the invention. The weight ratio of the former to the latter may be 10:90 to 90:10.

The present invention will be hereinafter explained further in detail by following examples.

REFERENCE EXAMPLE 1

In a glass-lined 1 l autoclave, pure water (500 ml), $I(CF_2)_4I$ (0.75 g), $ICH_2CF_2CF_2OCF{=}CF_2$ (2.2 g), $Na_2HPO_4.12H_2O$ (5 g), $C_3F_7—OCF(CF_3)CF_2—OCF(CF_3)COONH_4$ (50 g) and perfluorovinyl ether (200 g) of the formula:

$$C_3F_7—[OCF(CF_3)CF_2]_2—OCF{=}CF_2$$

were charged and the interior of the autoclave was thoroughly purged with nitrogen. Then, tetrafluoroethylene was injected at 30° C. with stirring to a pressure of 3 kg/cm²G.

Thereafter, an aqueous solution (10.4 g/l) of sodium sulfite 1 ml and an aqueous solution (18.8 g/l) of ammonium persulfate 1 ml were separately injected in the autoclave with tetrafluoroethylene gas as a propellant to initiate polymerization.

As the reaction proceeded, the pressure dropped. When the pressure decreased to 2.0 kg/cm²G, tetrafluoroethylene was injected to increase the pressure to 3.0 kg/cm²G. The reaction was continued for 8 hours and 15 minutes while repeating the decrease and increase of the pressure. Then, the unreacted monomers were eliminated to terminate the reaction. The product was an aqueous dispersion containing 20.5% by weight of a copolymer of tetrafluoroethylene, $C_3F_7—[OC(CF_3)CF_2]_2—OCF{=}CF_2$ and $ICH_2CF_2CF_2O—CF{=}CF_2$.

REFERENCE EXAMPLE 2

In a glass-lined 400 ml autoclave, pure water (200 ml), $C_7F_{15}COONH_4$ (4.4 g) and perfluorovinyl ether (70 g) of the formula:

$$C_4F_9OCF{=}CF_2$$

were charged and the interior of the autoclave was thoroughly purged with nitrogen. Then, tetrafluoroethylene was injected at 50° C. with stirring to a pressure of 4.0 kg/cm²G.

Thereafter, an aqueous solution (10 g/l) of ammonium persulfate 10 ml was injected in the autoclave with tetrafluoroethylene gas to initiate polymerization.

As the reaction proceeded, the pressure dropped. When the pressured decreased to 3.0 kg/cm²G, tetrafluoroethylene was injected to increase the pressure to 4.0 kg/cm²G. The reaction was continued for 5 hours and 13 minutes while repeating the decrease and increase of the pressure. Then, the unreacted monomers were eliminated to terminate the reaction. The product was an aqueous dispersion containing 13.25% by weight of a copolymer of $C_4F_9O—CF{=}CF_2$ and tetrafluoroethylene with a molar ratio of 41.2:58.8.

EXAMPLE 1(1)

A commercially available Tetoron (trade name) cloth was dipped in the aqueous dispersion prepared in Reference Example 1 for about 20 seconds and dried at 100° C. for 10 minutes to prepare a sample cloth.

EXAMPLE 1(2)

A commercially available Tetoron (trade name) cloth was dipped in the aqueous dispersion prepared in Reference Example 1 for about 20 seconds and dried at 100° C. for 10 minutes twice. The cloth was again dipped in the same dispersion for about 20 seconds and dried at 100° C. for 10 minutes to prepare a sample cloth.

EXAMPLES 2(1) AND 2(2)

In the same manner as in Examples 1(1) and 1(2) but using a Nylon (trade mark) cloth in place of the Tetoron cloth (trade name), sample cloths were prepared, respectively.

EXAMPLES 3(1) AND 3(2)

In the same manner as in Examples 1(1) and 1(2) but using a Tetoron/cotton (65:35) blended cloth in place of the Tetoron cloth, sample cloths were prepared, respectively.

EXAMPLE 4

In the same manner as in Example 1(1) but using a cotton cloth in place of the Tetoron cloth, a sample cloth was prepared.

EXAMPLES 5-7

In the same manner as in Example 1(1), 2(1) and 3(1) but using the dispersion prepared in Reference Example 2 in place of that prepared in Reference Example 1, sample cloths were prepared, respectively.

EXAMPLE 8

In the same manner as in Example 1(1) but using a glass fiber cloth in place of the Tetoron cloth and the dispersion prepared in Reference Example 2 in place of that prepared in Reference Example 1, a sample cloth was prepared.

Resistance to 50% hydrofluoric acid of the impregnated glass fiber cloth and the glass fiber cloth was examined. The impregnated glass fiber cloth of the invention was water repellent and had good corrosion resistance, while the untreated glass fiber cloth was easily wetted with hydrofluoric acid and corroded.

EXAMPLE 9

In the same manner as in Example 8 but using a 50 mesh SUS net in place of the glass fiber cloth and the dispersion prepared in Reference Example 2, a sample material was prepared.

The impregnated SUS net and an untreated SUS net were dipped in 10% hydrochloric acid for 10 minutes and then placed in the air for 24 hours. The number of the rusted spots per 10 cm square of the impregnated net was 0 (zero), while that of the untreated net was enormous.

COMPARATIVE EXAMPLES 1-3

In the same manner as in Example 1 but using an aqueous dispersion containing 23% of a copolymer of vinylidene fluoride/hexafluoropropylene/tetrafluoroethylene (molar ratio=50:30:20) in place of the dispersion prepared in Reference Example 1 and one of following cloths, a sample cloth was prepared:

Tetoron cloth (Comparative Example 1)

Nylon cloth (Comparative Example 2)

Tetoron/cotton blended cloth (Comparative Example 3).

COMPARATIVE EXAMPLES 4-6

The same cloths as used in Comparative Examples 1-3 but not impregnated were used as sample cloths, respectively.

The properties of the sample cloths prepared in Examples 1-7 and Comparative Examples 1-6 were examined.

WATER AND OIL-REPELLENCY OF THE CLOTH

A contact angle of water or acetone against the cloth was measured at 25° C.

MOISTURE PERMEABILITY

An aluminum made cup containing 21 ml of water was sealed with the cloth and kept in a dry atmosphere at 50° C. for 64 hours. The weight loss of water was measured and shown in the Table by percentages.

GAS PERMEABILITY

By means of a tester used for measuring gas permeability of paper and cardboard, a period of time required for permeating 100 ml of air was measured according to JIS D 8117.

The results are shown in the Table.

TABLE

| Example No. | Amount of impregnated polymer (g) | Contact angle (deg) Water | Contact angle (deg) Acetone | Gas permeability (sec.) | Moisture permeability (%) |
|---|---|---|---|---|---|
| Comp. 1 | 0.16 | 95 | 15> | 0.5> | — |
| 1 (1) | 0.15 | 103 | 50 | 0.5> | 1.67 |
| 1 (2) | 0.21 | 113 | 54 | 0.5-1.0 | — |
| Comp. 2 | 0.21 | 97 | 15> | 0.5> | — |
| 2 (1) | 0.18 | 103 | 47 | 0.5> | — |
| 2 (2) | 0.28 | 105 | 51 | 1.0 | — |
| Comp. 3 | 0.18 | 90 | 15> | 0.5> | — |
| 3 (1) | 0.29 | 110 | 54 | 1.0 | 1.71 |
| 3 (2) | 0.43 | 125 | 61 | 30 | — |
| 4 | 0.11 | 113 | 54 | 0.5> | 1.39 |
| 5 | 0.18 | 122 | 57 | 0.5> | 1.11 |
| 6 | 0.15 | 129 | 61 | 0.5> | — |
| 7 | 0.11 | 124 | 61 | 0.5> | — |
| Comp. 4 | — | 89 | 15> | 0.3> | 1.51 |
| Comp. 5 | — | 96 | 15> | 0.3> | 1.56 |
| Comp. 6 | — | 20> | 15> | 0.3> | 1.85 |

What is claimed is:

1. An impregnated material comprising an organic or inorganic material selected from the group consisting of a woven fabric, a non-woven fabric and an open cell porous material which is impregnated with a copolymer which comprises 50 to 95% by mole of repeating units derived from tetrafluoroethylene and 5 to 50% by mole of repeating units derived from perfluoroalkyl vinyl ether of the formula:

$$CF_2{=}CFOR_f \quad (I)$$

wherein $R_f$ is a $C_1$-$C_6$ perfluoroalkyl group or a group of the formula:

$$-(CF_2CFXO)_n-R_f \quad (II)$$

wherein $R_f$ is the same as defined above, X is a fluorine atom or a trifluoromethyl group and n is an integer of 1 to 10.

2. An impregnated material according to claim 1, wherein the copolymer further comprises at least one of other fluorine-containing ethylenically unsaturated comonomer.

3. An impregnated material according to claim 2, wherein the content of other comonomer is 0.1 to 20% by mole based on the total mole of tetrafluoroethylene and the perfluoroalkyl vinyl ether (I).

4. An impregnated material according to claim 2, wherein at least one of other comonomer is a fluorine-containing vinyl ether of the formula:

$$CF_2{=}CFO{-}(CF_2CF_2)_n{-}CH_2Y \qquad \text{(III)}$$

wherein n is the same as defined above, and Y is an iodine atom or a bromine atom.

* * * * *